US006479947B1

(12) United States Patent
Newsome

(10) Patent No.: US 6,479,947 B1
(45) Date of Patent: Nov. 12, 2002

(54) ULTRAVIOLET FLUORESCENT LAMP WITH UNIQUE DRIVE CIRCUIT

(76) Inventor: Donald Ellis Newsome, 16605 127th Ave. SE., Renton, WA (US) 98058

( * ) Notice: Subject to any disclaimer, the term of this patent is extended or adjusted under 35 U.S.C. 154(b) by 5 days.

(21) Appl. No.: 09/687,696

(22) Filed: Oct. 13, 2000

(51) Int. Cl.[7] ..... H05B 41/14; G03G 21/00

(52) U.S. Cl. ..... 315/277; 315/309; 315/276; 315/112; 315/117

(58) Field of Search ..... 315/112–120, 244, 315/291, 219, 307, 309, 276, 224, 277, 278

(56) References Cited

U.S. PATENT DOCUMENTS

| | | | | |
|---|---|---|---|---|
| 1,961,749 A | | 6/1934 | Ewest | 176/126 |
| 1,995,018 A | | 3/1935 | Spanner | 250/27.5 |
| 2,097,261 A | | 10/1937 | Spanner | 176/124 |
| 2,307,971 A | | 1/1943 | Stirnkorb | 176/124 |
| 3,631,317 A | | 12/1971 | Miyajima | 315/94 |
| 3,919,595 A | | 11/1975 | Willis, Jr. | 315/257 |
| 4,051,407 A | | 9/1977 | van der Werf et al. | 315/106 |
| 4,247,803 A | | 1/1981 | Walz | 315/289 |
| 4,451,763 A | | 5/1984 | Sodini | 315/159 |
| 4,517,498 A | | 5/1985 | Crawford | 315/323 |
| 4,574,220 A | | 3/1986 | Tate | 315/57 |
| 4,866,347 A | | 9/1989 | Nuckolls et al. | 315/158 |
| 4,902,942 A | | 2/1990 | El-Hamamsy | 315/276 |
| 5,059,870 A | | 10/1991 | Choon | 315/289 |
| 5,084,652 A | | 1/1992 | Kakitani | 315/219 |
| 5,107,183 A | | 4/1992 | Yamamoto et al. | 315/209 R |
| 5,486,739 A | * | 1/1996 | Roberts | 315/277 |
| 5,754,012 A | | 5/1998 | Locascio et al. | 315/307 |
| 5,825,137 A | | 10/1998 | Titus | 315/291 |
| 5,898,277 A | * | 4/1999 | Farnsworth et al. | 315/277 |
| 6,087,781 A | * | 7/2000 | Leppelmeier | 315/277 |
| 6,100,644 A | | 8/2000 | Titus | 315/209 R |

* cited by examiner

*Primary Examiner*—Don Wong
*Assistant Examiner*—Wilson Lee
(74) *Attorney, Agent, or Firm*—Polly L. Oliver

(57) ABSTRACT

A unique drive circuit for a fluorescent lamp, as well as a housing for such lamp and drive circuit, are designed for mineral museum displays. The drive circuit comprises a ballast subcircuit, a separate filament transformer subcircuit for pre-heating the lamp cathodes, and a relay between the subcircuits. The separate filament transformer subcircuit obviates the need for a conventional starter circuit for the fluorescent lamp. This way of pre-heating the cathodes prolongs the useful life of the lamp by making it possible for the lamp to undergo thousands of "on-off" cycles without the heretofore usual deterioration of the cathodes. The relay prevents the high voltage of the ballast from "hitting" the lamp cathodes before the cathodes have been pre-heated by the transformer subcircuit. Also a method is designed for using such a lamp, drive circuit, and housing to irradiate fluorescent minerals in a display case.

13 Claims, 3 Drawing Sheets

ULTRAVIOLET FLUORESCENT LAMP WITH UNIQUE DRIVE CIRCUIT

FIELD OF THE INVENTION

This invention relates generally to fluorescent lamps and more particularly to an ultraviolet fluorescent lamp assembly comprising a unique drive circuit and housing.

BACKGROUND OF THE INVENTION

The fluorescent lamp is a gas discharge tube that is used for lighting purposes. Generally, the inner surface of the wall of the tube is coated with light-emitting substances—usually fluorescent or phosphorescent metallic salts, and the tube is filled with mercury vapor at extremely low pressure and has filaments at each end of the tube. The light of the fluorescent lamp is not produced by an incandescent body (such as the filament of an ordinary electric lamp), but is emitted as a result of the excitation of atoms (namely, those of the mercury vapor and the fluorescent coating) and is extremely economical. The electrons ejected from the cathode filaments collide with the mercury atoms of the vapor and cause the mercury atoms to emit radiation which consists for the most part of ultraviolet rays, which are invisible. The ultraviolet light strikes the fluorescent substance with which the wall of the tube is coated and, depending upon the coating, may cause the substance to emit radiation with a longer wavelength in the visible rage of the spectrum—i.e., the coating may transform the invisible rays into visible light.

The conventional fluorescent lamp has to be operated with a choke (normally referred to as a ballast), which prevents a harmful rise in voltage and serves to ignite the lamp. For this purpose a starter circuit comprising a small auxiliary glow lamp provided with a thermal contact is usually connected in parallel with the main lamp. When the current is switched on, the glow lamp first lights up (the thermal contact is now open). This causes the contact to warm up and close, with the result that the glow lamp is short-circuited and the cathodes of the main lamp receive the full current. The thermal contact then cools and breaks, providing a voltage surge which is high enough to initiate the discharge in the fluorescent lamp itself. Because it is bypassed by the main lamp, the small auxiliary glow lamp then ceases to function.

Ultraviolet fluorescent lamps are often used in museum and other displays where powerful lighting is required to properly irradiate and display fluorescent mineral specimens. Fluorescent lamps are used with special ultraviolet filters that transmit the ultraviolet light and absorb the visible light that is generated by the lamps. However, most ultraviolet fluorescent lamps in use today have short useful life spans, and it is most commonly due to the inability of conventional drive circuits with conventional starter circuits to handle the high number of on-off cycles necessary in such a museum or other display. Another drawback of the currently available lamps is that no manufacturer of commercial ultraviolet lights uses a high output lamp.

Many prior inventors, such as Ewest and Yamamoto, have recognized the need to improve the starting and operating efficiency of fluorescent lamps. However, these prior art patents are directed simply to alternative designs of starter circuits. Ewest, in U.S. Pat. No. 1,961,749, discloses a gaseous electric discharge device which uses an auxiliary electrode in addition to the main electrode at one end of he lamp tube. This auxiliary electrode in proximity to the main electrode serves as a starter "glow lamp" component for the main lamp. Ewest's device also uses a high frequency apparatus to ionize the gas within the tube.

Yamamoto et al., in U.S. Pat. No. 5,107,183, disclose a fluorescent lamp which also uses a special arrangement of electrodes at one end or both ends of the lamp to constitute a starter "glow lamp" component. Both Ewest's device and Yamamoto's device, because they use the same current supply to start the lamp as well as to maintain operation of the lamp, would have the same short lifespans of other extant devices.

SUMMARY OF THE INVENTION

One aspect of the present invention comprises a drive circuit for an ultraviolet (UV) lamp that does not use a conventional starter circuit.

The preferred embodiment of the drive circuit is designed around three unique custom-made lamps, and each circuit comprises at least one custom-made generally tubular lamp (sometimes called a bulb) that can be either short wave (made from a clear quartz tube that has a high UV-C transmission at 253.7 nm of about 90%), medium wave (made from a special erythemal glass with a UV-B phosphor on the inside of the lamp that will transmit the 306 nm wavelength), or long wave (made from a common soda-lime glass tube with a UV-A phosphor on the inside of the lamp that will transmit a peak output at 352 nm). Each lamp is a Rapid Start High Output lamp operating at the maximum amount of lamp current for that diameter and length of lamp. Each lamp has tungsten wire filaments on each end. In the making of the lamp the filaments are coated with an electron-emissive material (e.g., barium, strontium, and calcium as compounds) to turn them into lamp cathodes. The cathodes are designed for High Output lamp current. In addition there are wire or metal anodes on each cathode, the anodes helping prolong the life of the emissive material. Each lamp has a standard bi-pin base at each end, and in the preferred embodiment, all lamps are the same length (e.g., 22 ⅜ inches from pin to pin) so that they are interchangeable within the entire assembly.

In addition to the lamp, the preferred embodiment of the drive circuit also comprises at least one each of a ballast subcircuit with ballast element and a transformer subcircuit with transformer element, and a lockout relay. The present invention of the drive circuit need not include the lockout relay; however, the relay is included in the preferred embodiment as an additional check upon the safe and correct operation of the drive circuit. The lockout relay prevents the high voltage of the ballast from being supplied to the lamp cathodes until the transformer subcircuit is powered and the lamp cathodes have been pre-heated.

The ballast element, which may be any type of appropriate ballast (such as an electronic ballast, but in the preferred embodiment is a conventional electromagnetic ballast), of the ballast subcircuit supplies high voltage (arc voltage) between the lamp cathodes at each end of the lamp. The ballast used in the preferred embodiment is a conventional electromagnetic ballast, but the filament windings are not used, and only one wire from each end of the ballast (high voltage) is connected to each end of the lamp. (Normally two wires from each end are connected to two pins of each end of the lamp.) For pre-heating the cathodes, the preferred embodiment of the drive circuit also comprises a separate transformer subcircuit which is used to supply low voltage (starter voltage) to the lamp cathodes, and which precludes the necessity of a conventional starter circuit. The transformer has two secondaries and four output leads, two per secondary, which lead to the lamp cathodes. In this way, cathode heat is supplied to each end of the lamp separate from the ballast. The transformer is always powered up before the high voltage from the ballast is supplied.

The average rated life of the lamp is greatly extended by having the filaments (cathodes) heated first before the high voltage (arc current) is applied. Heating the cathodes causes a space charge of electrons to form around the cathode filaments, the cloud of electrons helping to repel the heavy mercury (Hg) ions from impinging on the electron emissive material that is on the cathodes. Being repelled, the ions do not knock off emissive material that is on the cathodes. The lamps also have two anode wires on either side of the cathodes, which attract the ions away from the cathodes. This helps to prolong the life of the lamp, since the life of a fluorescent lamp is a function of the amount of emissive material that is on the cathodes. The resulting lamp life should approximate the continuous burning rated life of that particular lamp.

By having the lamp cathodes heated first, the high voltage from the ballast can be switched on and off thousands of times without effecting the life of the lamp. It also means that the output of the lamp is almost at full output when it is turned on and there is no "flickering" or "warming up", especially if the lamp has had a few on-off cycles first. The advanced heating of the cathodes means that the lamp is effectively "instant start" in application, i.e., the lamp will light to full output as soon as the ballast subcircuit is switched on, providing an economical operation, and no starters are required. Most other ultraviolet display lights have very reduced lives of their lamps because the lamps are turned on and off many thousands of times and often fail within a few thousand or maybe even a few hundred on-off cycles. In the preferred embodiment of the present invention, an on-off rocker switch is installed on the outside of the lamp housing assembly to turn on the high voltage of the ballast after the low voltage of the transformer has already been applied to the cathodes.

The lock-out relay of the preferred embodiment is a conventional electromagnetic relay situated between the two subcircuits of the ballast and the transformer. The lock-out relay ensures that the ballast subcircuit will not be completed unless there is current in the transformer subcircuit. In this way, the lamp cathodes are protected from inadvertently being "hit" with the high voltage from the ballast unless they have been pre-heated by the transformer. This additional safety feature protects the circuit and prolongs the life of the lamp.

The lamp with its unique circuitry could be housed in any appropriate way that is fitting for the particular application. Obviously, there are other applications for such a fluorescent display than specifically for museum purposes.

However, another aspect of the present invention comprises a housing appropriate for use in a museum or other display case, in addition to the drive circuitry. This embodiment of the present invention includes a generally rectangular housing made of lightweight, coated aluminum comprising a box and cover. The box of the preferred embodiment is designed to house the lamp, lamp sockets, ballast, transformer, and lockout relay, as well as a terminal strip (in the preferred embodiment) and two safety fuses (one for the ballast subcircuit and one for the transformer subcircuit). The box of the preferred embodiment also houses a cooling fan, air dam, and reflector, and has a light baffle attached to the exterior of each end. The box of the preferred embodiment includes four protruding tabs on the sides of the box near the four corners. The housing can be easily installed in a display case by attaching wires or chains from the protruding tabs to the ceiling of the display area. Different lengths of wire or chain can be used to tilt the housing in the desired direction. Alternatively, the housing can be permanently attached to a display case through use of threaded nuts provided at appropriate locations on the top of the housing.

The housing is constructed so that only one hand-turned captive screw is required to secure the cover to the box. That one hand-turned screw makes it easy for a user to manually gain access to the interior of the box to replace the lamp while the housing is still mounted in the display case. Most other UV display lights have screws on several sides of the box and cover requiring a screwdriver or other tool for removal. Frequently, with other display light assemblies, the entire housing must be removed from the display case for a user to change the lamp or the filters.

The light assembly of the preferred embodiment has an ultraviolet filter located within the housing cover that is designed to transmit ultraviolet and absorb visible light that is generated by the lamp. A short wave filter may be used for short wave (SW), medium wave (MW), or long wave (LW) ultraviolet applications, while a long wave filter may be used for the long wave ultraviolet application. The combination of the custom-made lamp (SW, MW, or LW) and the correct filter makes the present invention useful for all ultraviolet wavelengths that are used in fluorescent mineral displays.

Once the cover is unscrewed by the hand-turned screw and is hanging free on its hinges, then the cover can be slid to the side and the cover will come off. The cover is attached by slip-hinges just for that purpose. Once the cover is removed it can be taken to a more suitable work area to replace the filters. The two identical filters are held in place by unique aluminum filter holders with "fingers," which distribute the load evenly along the length of the filters. As the filters are generally quite expensive, two filters are used end-to-end so if one is accidentally broken, a larger whole filter will not have to be replaced. Short-wave ultraviolet filters necessarily solarize and so must be replaced periodically. (Obviously, only one large filter could be used, or any number of smaller filters.) The filter-holding "fingers" are intended to make a snug fit to hold the filters, but without putting so much pressure on the filters that they might crack the filter. When the filter holders are tightened, the "fingers" will "give" some so that a more uniform pressure is applied to the filter edges without cracking the filter.

The preferred embodiment makes use of a terminal strip to organize all of the wires of the circuit. The terminal strip is not necessary to the invention, but in the preferred embodiment is located at one end of the interior of the box where the power cords enter the box and their component wires must be separated and routed to the appropriate subcircuit components. One safety fuse is provided for each power cord at the point where the power cord enters the box.

The fan helps to cool the lamp so that the mercury (Hg) vapor pressure in the lamp is kept relatively constant. If the Hg vapor pressure inside the lamp heats too much, the UV output will temporarily decrease. By maintaining a relatively constant airflow over the lamp, the Hg vapor pressure stays relatively constant and therefore the UV output stays constant. The high power of the custom-made lamps of the present invention is enhanced by maintaining an optimum temperature inside the lamp (i.e., other UV lamps lose output when heat in the lamps builds up). In the preferred embodiment, the fan is on any time the ballast subcircuit is powered; however, with different wiring configurations, the fan could be controlled by the transformer subcircuit or even by its own fan subcircuit.

The air dam of the preferred embodiment, although not necessary to the invention, is located at a convenient point between the reflector and the end wall and is intended not only to isolate the air within the electrical area, but also to force the airflow from the fan past the lamp tube in order to cool the gas in the tube.

Although there may be an optimum curvature to the reflector for maximum light output from the display case, in the preferred embodiment, the curvature chosen is a default for the configuration of the entire light assembly. The reflector of the preferred embodiment comprises a generally rectangular sheet of reflective coated aluminum which is curved around the tubular lamp and located within the box between the lamp and the drive circuit elements. The reflector has the effect of isolating the lamp from the other electrical components and elements in the housing and redistributing and directing all of the light from the lamp through the filters in the cover of the display case. The light baffles at either end of the box serve to reduce, if not entirely eliminate, the spillage of light from the interior of the box through any pathway but the filters in the opening in the cover.

The housing of the preferred embodiment also comprises several safety features. The electrical fuses have already been discussed. These fuses are normally located on the outside of one end of the housing so that they can be easily reached for maintenance. In addition to the fuses, there are warning labels on three sides of the housing stating that there should be a protective glass or plastic window between the short-wave or medium-wave light and any person's eyes or skin. There also are, in the preferred embodiment, four rubber feet on the outside of the cover, which serve to protect the filters from breakage when the cover is being set down for any purpose.

DETAILED DESCRIPTION OF THE PREFERRED EMBODIMENT

Figure 1:
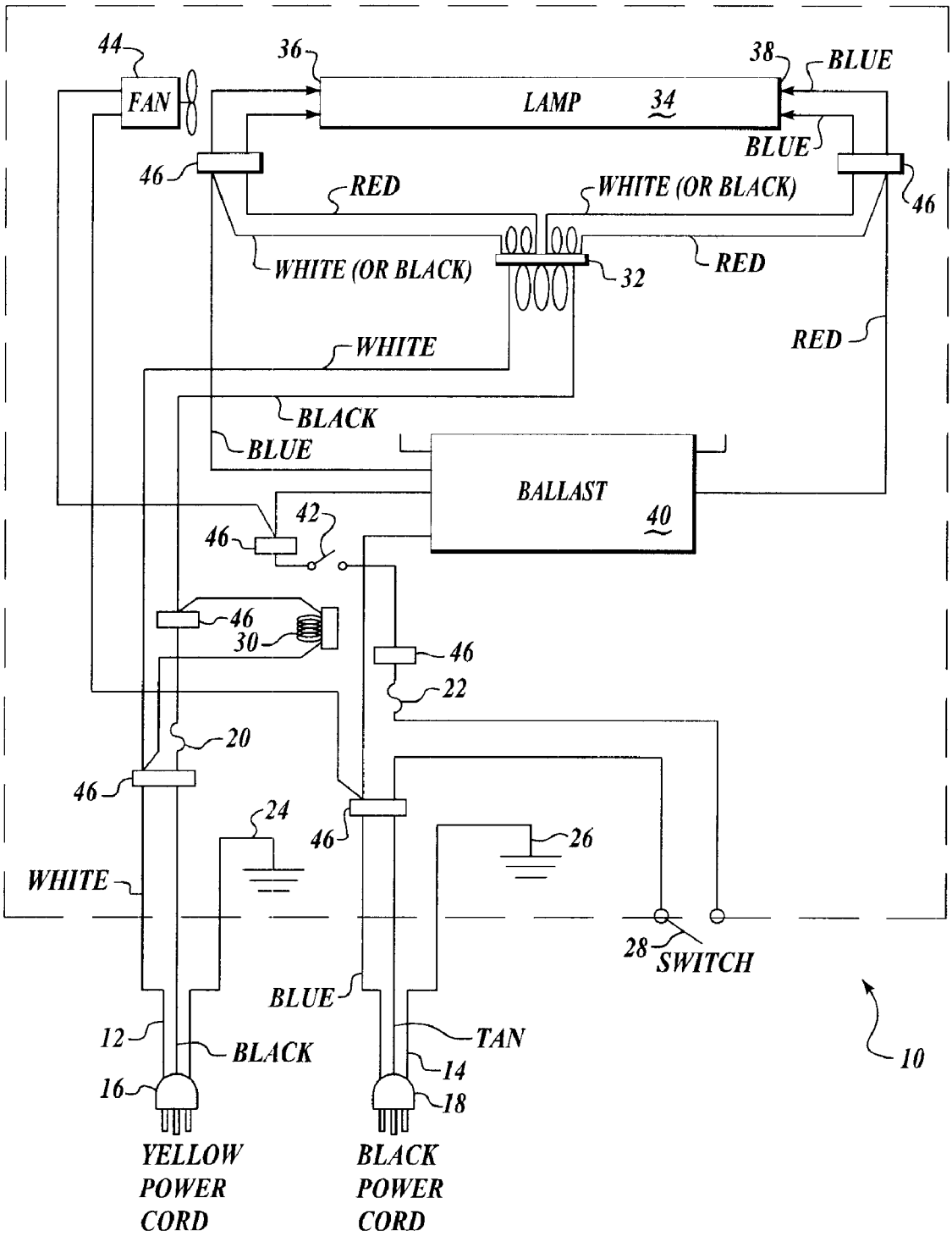
FIG. 1 is a schematic diagram of the lamp drive circuit of the preferred embodiment.

FIG. 1 illustrates the preferred schematic layout of the drive circuit 10. On the figure, [somewhat random] wire color designations have been preserved to clarify the circuit layout for the reader, and some labels, as well as reference numbers, have been provided for circuit elements.

There are two distinct subcircuits: the transformer subcircuit 12 powered by the yellow power cord and the ballast subcircuit 14 powered by the black power cord. Each subcircuit includes a plug, respectively 16 and 18, to connect to the power source and a safety fuse, respectively 20 and 22. Each subcircuit also includes a ground wire, respectively 24 and 26, and the ballast subcircuit 14 further includes a switch 28, in the preferred embodiment. The transformer subcircuit 12 of the preferred embodiment does not include a switch because the transformer circuit 12 is intended to be always "on" while it is plugged in. In alternate embodiments, there could be a switch in the transformer subcircuit 12, so that the yellow power cord could be left plugged in at all times without having current in the subcircuit.

As the reader can see from following the white and black wires from the plug 16, the transformer subcircuit 12 comprises an electromagnetic relay coil 30 and a filament transformer 32 as well as the fluorescent lamp 34. When the plug 16 is fitted into a wall socket or other acceptable power source, electric current will activate the filament transformer 32, which is a step-down transformer, and in turn deliver power to the lamp 34 via the lamp sockets 36 and 38, not shown in detail, at either end of the lamp 34. The transformer current heats up the lamp cathodes (not shown) at either end of the interior of the lamp 34, so that they will be pre-heated, primed, and ready for the high voltage from the ballast 40.

As the reader can see from following the blue and tan wires from the plug 18, the ballast subcircuit 14 comprises the switch 28, a ballast 40, an electromagnetic relay armature 42, and a fan 44, as well as the fluorescent lamp 34. When the plug 18 is fitted into a wall socket or other acceptable power source, current becomes available to the subcircuit 14, but does not travel along the subcircuit 14 until the switch 28 is thrown. In addition, there is another check on the circuit 14, i.e., the electromagnetic lock-out relay consisting of the coil 30 and the armature 42.

The armature 42 is normally held in the open position as shown. When current flows through the coil 30, on the transformer subcircuit 12, the armature 42 will be moved into the closed position, completing the ballast subcircuit 14 so that the ballast 40 can be powered. With this lock-out relay between the subcircuits 12 and 14, the ballast subcircuit 14 cannot be powered regardless of the connections of the plug 18 or the switch 28 unless the transformer subcircuit 12 has already been powered, and the lamp 34 is consequently protected from experiencing the initial surge of the high voltage of the ballast circuit 14 while the lamp cathodes are still cold.

The terminal strip of the preferred embodiment of FIG. 1 is represented by the terminal strip blocks 46. Each power cord (yellow and black) that enters the box contains three wires. The wires are separated and affixed to the terminals of the terminal strip 46. From there, wires are directed to the appropriate subcircuits or elements.

Figure 2:
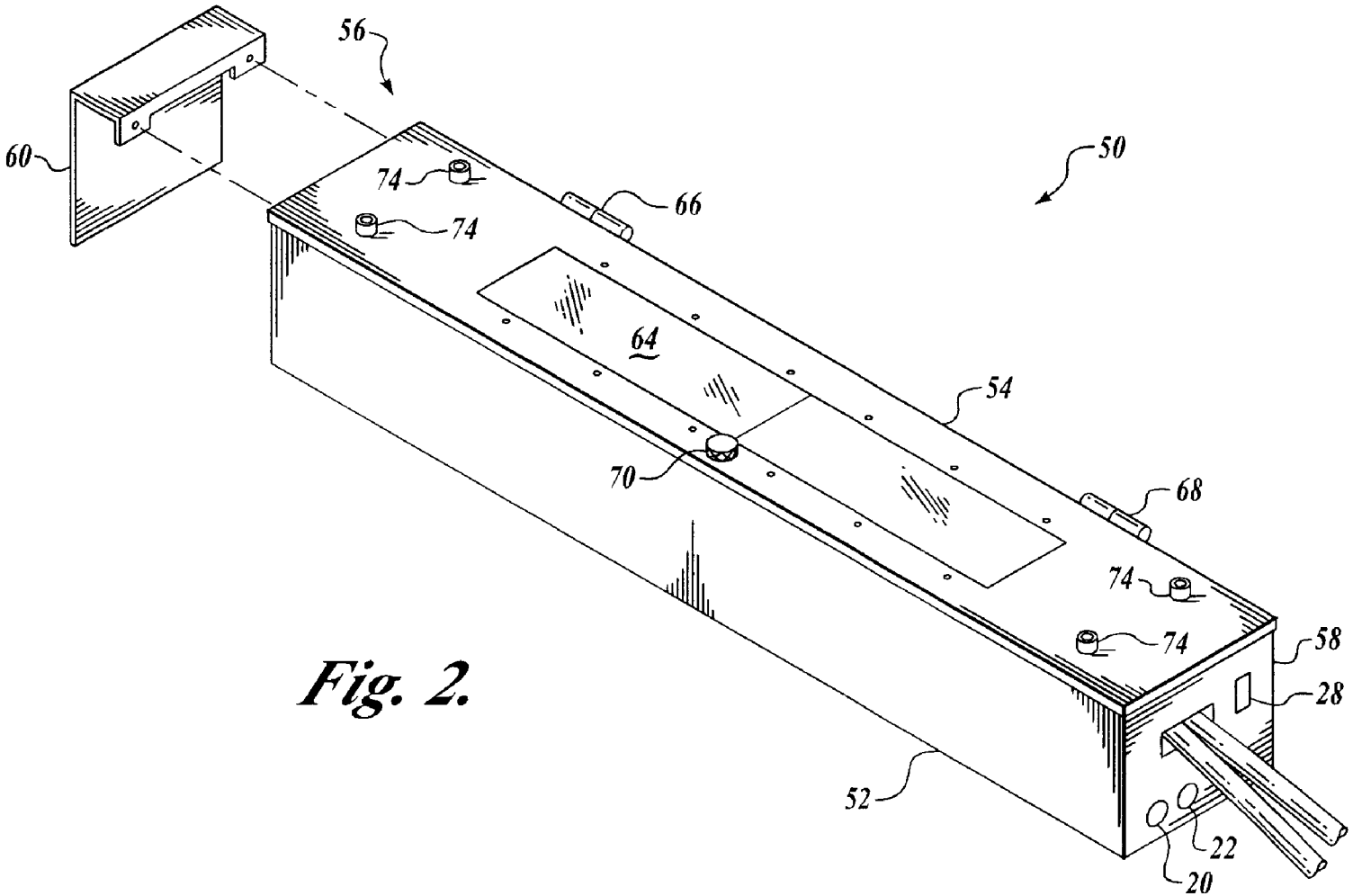
FIG. 2 is a partially exploded perspective view of the preferred embodiment of the fluorescent ultraviolet light assembly housing.

FIG. 2 shows a preferred embodiment of the housing 50 which encases and encloses the drive circuit 10 described above and is designed to be used in a fluorescent mineral display case (not shown). Although the housing 50 is shown with the cover on the top, it is understood that in most display case applications, the cover (with the special ultraviolet filters) will actually be directed downward.

The housing 50 comprises a box 52 and cover 54. The box 52 holds the lamp 34 and the various elements of the drive circuit 10 and is represented on FIG. 1 by the generally rectangular dashed line enclosing the wire diagrams. The walls of the box 52 of the preferred embodiment are constructed of aluminum sheets coated for durability; however, any other acceptable metal or plastic material could be used. The end wall 56 (not shown) defines a generally circular cutout to accommodate the fan 44. The opposite end wall 58 defines a generally rectangular or square cutout to accommodate the entry of the yellow and black power cords of the drive circuit 10 and also to allow the exit of the airflow from the fan 44. The shapes of both cutouts could be changed; however, circular and rectangular, respectively, were chosen for convenience and ease of manufacture.

The end wall 58 defines two additional generally circular cutouts for accommodating the two fuses 20 and 22. This arrangement allows for easy checking and replacement of the fuses. The end wall 58 further defines a small opening for the rocker switch 28 of the preferred embodiment. The rocker switch 28 is mounted to the end wall so that it can be easily operated by a user to turn on and off the power to the ballast subcircuit 14. In alternate embodiments, the rocker switch 28 could be mounted to a side wall of the box 52 or need not be mounted to the box 52 at all. (For instance, the switch 28 could be located at a point along the black power cord.) Indeed, a different type of switch altogether could be used.

Two light baffles, 60 and 62 (62 is not shown for clarity), are attached to the box 52, one at either end, in order to block any errant light spilling from the interior of the housing 50 through the end wall cutouts. In the preferred embodiment, the light baffles 60 and 62 are simply bent sheets of black-painted aluminum, which are attached by screws to the end walls 56 and 58. The screws and baffles can be easily removed for cleaning and maintenance of the entire assembly.

The cover 54 defines a generally rectangular opening for the special ultraviolet filters 64, which in the preferred embodiment has been shaped and sized for optimum transmission. Alternatively, the cutout in the cover 54 and the filters 64 could be of different shapes or sizes, particularly for a specific display case application or lamp size.

The cover 54 is attached to the box 52 on one edge by two slip hinges 66 and 68. On the side of the cover opposite the slip hinges, 66 and 68, a single captive finger screw 70 secures the cover 54 to the box 52 to close the housing 50. There is a corresponding tab 72 on the interior of the box (not shown) to receive the shank of the captive finger screw 70.

Figure 4:
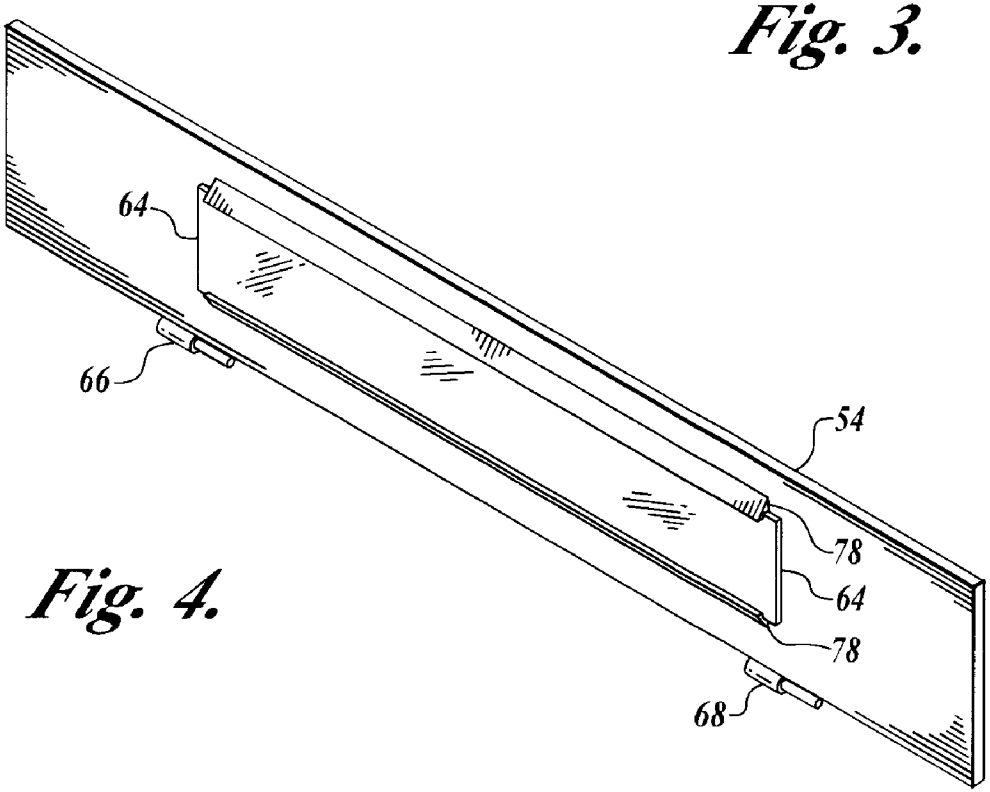
FIG. 4 is a detail view of the preferred embodiment of the cover of the housing.

There are four rubber feet 74 on the outside of the cover 54 which protrude at least as far as necessary from the cover 54 in order to protect the special ultraviolet filters 64 when the cover 54 is removed from the box 52 for cleaning or maintenance. Upon removal, the cover 54 is frequently set on a horizontal surface with the cutout in the cover 54 directed downwardly so that the filters 64 on the inside of the cover 54 (as shown in FIG. 4) can be cleaned or changed. Obviously, the feet 74 could still serve their purpose if they were made of metal or plastic or were arranged in a different pattern or of a different number. The rubber of the preferred embodiment was chosen for safety and durability.

Figure 3:
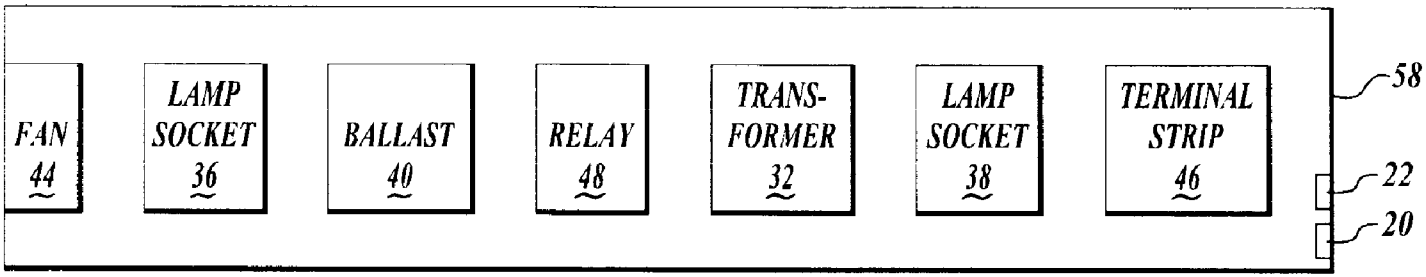
FIG. 3 is a top view simple block diagram of the interior of the box of the preferred embodiment of the light assembly, shown for clarity without the lamp or reflector.

FIG. 3 shows in a simple block diagram generally how the elements of the preferred embodiment are arranged within the box 52. For clarity, the reflector and the lamp 34 are not shown. Upon final assembly, the lamp 34 will fit into the lamp sockets 36 and 38, and the reflector will be fitted behind the lamp, i.e., between the lamp 34 and the ballast 40, the transformer 32, and the relay 48, with the reflective surface directed toward the lamp 34. Also in FIG. 3, the wires are not shown so that the reader can readily discern the arrangement of the elements. From end wall 58, the wires from the power cords encounter the terminal strip 46. From there, various wires are directed back to the fuses 20 and 22 or the onward to the other elements. Finally the wires of the ballast subcircuit are extended out to include the fan 44.

FIG. 4 shows the inside of the cover 54, illustrating how the filters 64 (two in the preferred embodiment) are held in place by the rails 78 with "fingers" (as discussed in the Summary section above). The rails 78 are in turn held in place with several small screws (not shown) extending through the rails 78 and the aluminum plate of the cover 54. It was chosen for the preferred embodiment to use two identical filters 64 instead of one large one that would extend the entire length of the cutout in the cover 54, for the reason that it is simpler, quicker, and more economical to replace one smaller filter 64 than a single larger one.

What is claimed is:

1. A drive circuit for a user operating a fluorescent lamp from a power source comprising:

a generally tubular lamp having a first end and a second end and defining an interior space, each end having a cathode filament and an anode extending into the interior space of the lamp, the cathode filament being coated with an electron-emissive material;

a transformer subcircuit comprising a transformer having one primary winding and two secondary windings, the primary winding being connected to the power source and each secondary winding having output leads which are connected respectively to the cathode filaments at each end of the lamp;

a separate ballast subcircuit comprising a Rapid Start High Output wound ballast connected to the power source and having at least one high voltage wire extending from each end of the ballast, the wires leading respectively to the first and second ends of the lamp and being connected to the cathode filaments; and a lock-out relay, comprising coil and armature, situated between the transformer subcircuit and the ballast subcircuit, the coil being within the transformer subcircuit and the armature being within the ballast subcircuit.

2. A drive circuit for a user operating a fluorescent lamp from two separate power sources comprising:

a generally tubular lamp having a first end and a second end and defining an interior space, each end having a cathode filament and an anode extending into the interior space of the lamp, the cathode filament being coated with an electron-emissive material;

a transformer subcircuit comprising a transformer having one primary winding and two secondary windings, the primary winding being connected to a first power source and each secondary winding having output leads which are connected respectively to the cathode filaments at each end of the lamp;

a separate ballast subcircuit comprising a Rapid Start High Output wound ballast connected to a second power source and having at least one high voltage wire extending from each end of the ballast, the wires leading respectively to the first and second ends of the lamp and being connected to the cathode filaments; and a lock-out relay, comprising coil and armature, situated between the transformer subcircuit and the ballast subcircuit, the coil being within the transformer subcircuit and the armature being within the ballast subcircuit.

3. The drive circuit of claim 1 wherein the lamp is chosen from the group of ultraviolet fluorescent lamps including short-wave and medium-wave lamps.

4. The drive circuit of claim 1 wherein the transformer subcircuit further comprises a user-operated switch, such switch being capable of alternately breaking and completing the transformer subcircuit.

5. The drive circuit of claim 1 wherein the transformer subcircuit further comprises a fan.

6. The drive circuit of claim 1 wherein the ballast of the ballast subcircuit is a conventional electromagnetic ballast of the Rapid Start High Output type wound with filament windings and capable of supplying high voltage through such filament windings.

7. The drive circuit of claim 1 wherein the ballast subcircuit further comprises a user-operated switch capable of alternately breaking and completing the ballast subcircuit.

8. The drive circuit of claim 1 wherein the ballast subcircuit further comprises a fan.

9. The drive circuit of claim 1 wherein the ballast subcircuit further comprises a switch timer capable of alternately breaking and completing the subcircuit at predetermined intervals.

10. The drive circuit of claim 1 wherein the relay is configured such that the armature of the ballast subcircuit is normally in the open position and is closed only when the transformer subcircuit is powered.

11. The drive circuit of claim 9 wherein the relay is in the normally open position.

12. A method for a user to operate a drive circuit for a fluorescent lamp, such lamp being generally tubular and defining an interior space and having cathode filaments and anodes extending into such interior space, and such drive circuit comprising a transformer subcircuit including a transformer connected to the lamp cathodes, a separate ballast subcircuit including a Rapid Start High Output wound ballast connected to the lamp cathodes, and a lock-out relay, consisting of coil and armature, situated between the transformer subcircuit and the ballast subcircuit, comprising the steps of:

powering the transformer subcircuit to heat the lamp cathodes with low voltage current; and then powering the ballast subcircuit to apply a high voltage current to the lamp cathodes while the transformer subcircuit continues to operate uninterruptedly.

13. The method of claim 12 wherein the ballast subcircuit includes a user-operated switch which is normally in the open position, and the transformer subcircuit is powered by the user connecting the subcircuit to a power source; and the ballast subcircuit, which is already connected to a power source, is powered by the user closing the user-operated switch so as to complete the ballast subcircuit.

* * * * *